US006869805B2

(12) United States Patent
Kubisch et al.

(10) Patent No.: US 6,869,805 B2
(45) Date of Patent: Mar. 22, 2005

(54) ELECTRICAL CONNECTION PASSING THROUGH A DIVIDING WALL

(75) Inventors: Jan Kubisch, Schönhofen (DE); Manfred Reichl, Emskirchen (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 10/772,504

(22) Filed: Feb. 5, 2004

(65) Prior Publication Data

US 2004/0171303 A1 Sep. 2, 2004

(30) Foreign Application Priority Data

Feb. 27, 2003 (DE) ..... 103 08 612

(51) Int. Cl.[7] ..... H01R 3/00
(52) U.S. Cl. ..... 436/500; 439/826
(58) Field of Search ..... 439/500, 626, 439/99, 100, 689, 621, 627, 862

(56) References Cited

U.S. PATENT DOCUMENTS 4,295,009 A * 10/1981 Weidler ..... 381/394
4,714,439 A * 12/1987 Marabotto et al. ..... 439/627
5,312,269 A * 5/1994 Hwang ..... 439/500
5,716,230 A * 2/1998 Marren et al. ..... 439/500
5,805,423 A * 9/1998 Wever et al. ..... 361/760
5,980,309 A * 11/1999 Frantz et al. ..... 439/500
6,182,484 B1 2/2001 Wolter ..... 70/395
6,296,492 B1 * 10/2001 Fujimoto et al. ..... 439/63
6,527,584 B2 * 3/2003 Ninomiya ..... 439/500
6,554,640 B1 * 4/2003 Koike et al. ..... 439/500
6,623,293 B1 * 9/2003 Wu ..... 439/500
6,669,504 B2 * 12/2003 Wu ..... 439/500
6,722,916 B2 * 4/2004 Buccinna et al. ..... 439/500
6,805,991 B2 * 10/2004 Abe ..... 429/56

FOREIGN PATENT DOCUMENTS

DE 34 19 333 A1 2/1985 ..... H01M/2/10

* cited by examiner

*Primary Examiner*—Ross Gushi
*Assistant Examiner*—Phuongchi Nguyen
(74) *Attorney, Agent, or Firm*—Baker Botts L.L.P.

(57) ABSTRACT

An electrical connection passing through a dividing wall contains a contact plate (2) having a base piece (4) covering a surface, and a contact piece (8) connected to the base piece via a connecting piece (6), wherein the perimeter of the base piece, including the attached area of the connecting piece, is held and sealed in the dividing wall (24), and the contact piece has an elastically deformable area (10) exposed for making contact with a component. The dividing wall seals a chamber of a housing in which is located an electrical circuit connected by a contact lug (12) of the base piece (4). Outside the chamber a battery compartment is provided in which is held a battery pressed elastically in position against a facing surface by the spring tongue (10).

17 Claims, 3 Drawing Sheets

ELECTRICAL CONNECTION PASSING THROUGH A DIVIDING WALL

CROSS REFERENCE TO RELATED APPLICATION

This application claims foreign priority of the German application DE 10308612.9 filed on Feb. 27, 2003.

TECHNICAL FIELD OF THE INVENTION

The invention relates to an electrical connection passing through a dividing wall, and an electrical device having such an electrical connection and a method for manufacturing such an electrical connection.

BACKGROUND OF THE INVENTION

There are numerous electrical devices that have an electrical circuit which is located inside a chamber hermetically sealed against moisture, for instance, and which is supplied with current from outside the chamber or which is connected to other circuits.

Often power is supplied via a battery, for example a button cell (e.g. in car keys with remote control function), the battery being pressed in a spring arrangement against a corresponding contact in order to provide both a reliable contact and a vibration-proof mounting.

SUMMARY OF THE INVENTION

The object of the invention is to create an electrical connection passing sealed through a dividing wall that allows a spring contact to be made with another component, for example a battery, at least on one side.

This object can be achieved by an electrical connection passing through a dividing wall, comprising a contact plate having a base piece covering a surface, and a contact piece connected to the base piece via a connecting piece, wherein the perimeter of the base piece, including the attached area of the connecting piece, is held and sealed in the dividing wall, and the contact piece has an elastically deformable area exposed for making contact with a component.

The object can also be achieved by an electrical connection for insertion into a dividing wall having an opening, comprising a contact plate having a base piece covering said opening, and a contact piece arranged on top of said base piece and coupled with said base piece via a connecting piece, wherein said contact plate fits in said opening of said dividing wall, and the contact piece has an elastically deformable area exposed for making contact with a component.

The base piece may seal an aperture/opening formed in the dividing wall. The elastically deformable contact piece can be formed by at least one spring tongue punched out of the contact piece. A contact lug may protrude sealed from the dividing wall from a perimeter area of the base piece on the opposite side from the contact piece. The base piece and the contact piece may have an approximately matching perimeter shape and are arranged one above the other by bending the connecting piece through about 180°, at least one spring tongue is punched out of the contact piece, the tongue projecting from the opposite side from the base piece. A contact lug may extend from a perimeter area of the base piece, and the perimeters of the base piece and contact piece arranged above each other can be held in the edge of the aperture of the dividing wall in such a way that the at least one spring tongue is exposed on one side of the dividing wall, and the contact lug is exposed on the other side of the dividing wall. The dividing wall may seal a chamber of a housing in which is held an electrical circuit connected to the contact lug, and the device may contain a battery compartment in which is held, allowing replacement, a battery pressed elastically in position against a facing surface by the spring tongue.

The object can furthermore be achieved by a method for manufacturing an electrical connection passing through a dividing wall, comprising the following steps:

- Manufacture of a flat part punched from metal plate having a base piece and a contact piece connected to the base piece via a connecting piece, wherein the base piece and the contact piece have approximately matching perimeter shapes, and a contact lug projects from a perimeter area of the base piece,
- Punching out of at least one spring tongue from the contact piece, and bending of the spring tongue out from the contact piece,
- Bending of the contact lug out of the base piece in the same direction as the spring tongue,
- Arranging base piece and contact plate above each other by bending the connecting piece through about 180° in such a way that the spring tongue projects on one side and the contact lug on the other.
- Introduction of the plate part formed in such a way into an injection molding tool in such a way that only the perimeter edges of base piece and contact piece and the bent-over connecting piece project sealed into a die cavity corresponding to the dividing wall, wherein the bent contact lug is located in a recess of the injection molding,
- Injection molding of the dividing wall, and
- Removal of the dividing wall from the injection molding tool together with the plate part held in the dividing wall at its perimeter edges and by the connecting piece.

BRIEF DESCRIPTION OF THE DRAWINGS

The invention is explained in further detail below by way of example with reference to the schematic diagrams, in which.

DETAILED DESCRIPTION OF THE PREFERRED EMBODIMENTS

Figure 1:
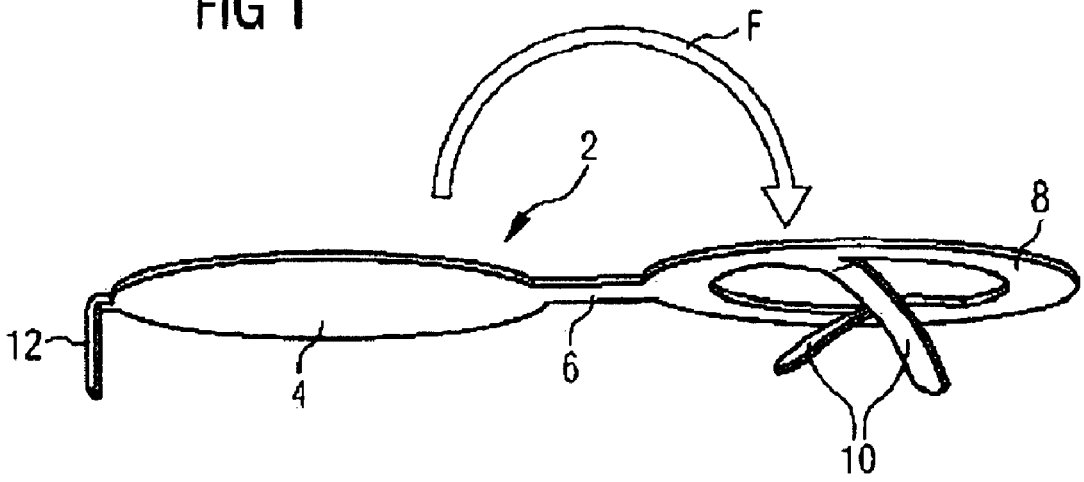
FIG. 1 shows in perspective view a contact plate for manufacturing an electrical connection.

FIG. 1 shows a contact plate generally labeled 2 having an approximately circular base piece 4, which is connected via a bridge-like connecting piece 6 to a contact piece 8, whose outer perimeter is also circular and matches the perimeter of the base piece 4. The inner area of the contact piece 8 is punched out in such a way that two resiliently flexible spring tongues 10 are formed, bent downwards as shown in FIG. 1. A contact lug 12 extends from the perimeter of the base piece 4 in an area opposite the connecting piece 6, bent downwards through about 90° as shown in FIG. 1.

The whole contact plate 2 is punched from one piece of sheet, the spring tongues and the contact lug being bent afterwards. The sheet material can be any suitable metal or metal alloy, from which the spring tongues 10 can be formed with elastic flexibility using suitable heat treatment if necessary. If a corrosion-proof metal with particularly elastic flexibility is used for the spring tongues 10, the spring tongues 10 can be connected to the ring-like contact piece 8 by welding or soldering or other means.

Figure 2:
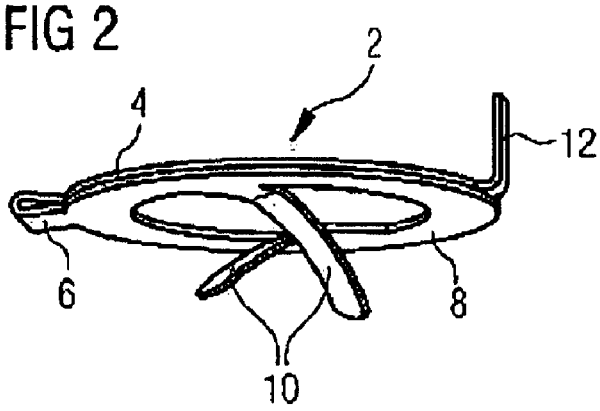
FIG. 2 shows the contact plate of FIG. 1 in a state prepared for injection molding.

As shown in FIG. 2, the contact plate 2 from the configuration of FIG. 1 is folded back-to-back onto the contact piece 8 by folding the base piece 4 through 180° (arrow F) and appropriate bending of the connecting piece 6, the outer edges of the contact piece 8 and the base piece 4 being arranged directly on top of each other.

Figure 3:
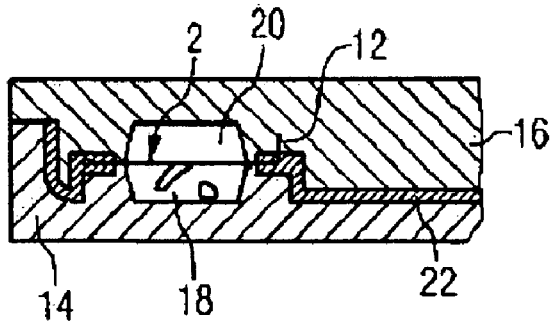
FIG. 3 shows a cross-section through a section of an injection-molding tool for manufacturing an electrical connection according to the invention.

The contact plate 2 is introduced in its state of FIG. 2 into an injection molding tool consisting of two pieces as shown in FIG. 3. The injection molding tool contains a lower part 14 and an upper part 16, each designed with a recess 18 and 20 respectively and, when lower part 14 and upper part 16 are arranged opposite each other, i.e. in the closed state of the injection molding tool, forming between them a die cavity 22 whose shape matches that of a dividing wall to be manufactured. In FIG. 3, the right-hand side of lower part 14 and upper part 16 are not shown in full.

A slot that can take the contact lug 12 is formed contiguous with the die cavity 2 in the upper part 16.

After placing the contact plate 2 in its configuration of FIG. 2 on the lower part 14, the spring tongues 10 project into the recess 18, and the perimeter area of the contact piece 8 lies on an area of the lower part 14 enclosing the recess 18. After closing the injection molding tool by bringing the upper part 16 onto the lower part 14, the perimeter areas of the base piece 4 and the contact piece 8 are held tightly between the edges of the recesses 18 and 20, and extend just into the die cavity 22 in which the connecting piece 6 is completely located. The contact lug 12 projects into the matching slot in the upper part 16.

Figure 4:
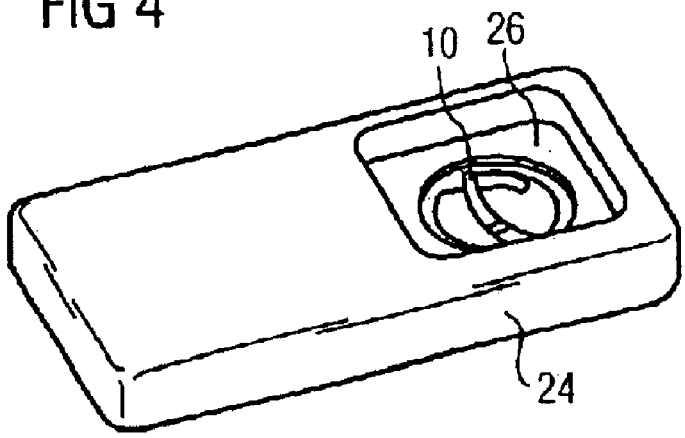
FIG. 4 shows a perspective view of a dividing wall with electrical connection applied to it.

In a way known in the art, the die cavity 22 is filled with plastic suitable for injection molding, so that the overlying edges of base piece 4 and contact piece 8, and the connecting piece 6, are completely molded in plastic. After removing the upper part 16 from the lower part 14, which can be done easily without any undercutting by moving the upper part 16 upwards as shown in FIG. 3, the finished dividing wall 24 with the integrally injection molded contact plate 2 can be removed as shown in FIG. 4. As can be seen, the dividing wall 24 is shaped in such a way that it forms a recess 26 below the injection-molded contact plate, into which the spring tongues 10 project. In FIG. 4 one cannot see the contact lug 12 projecting upwards. The recess 26 is sealed from above by the base piece 4 of the contact plate.

Figure 5:
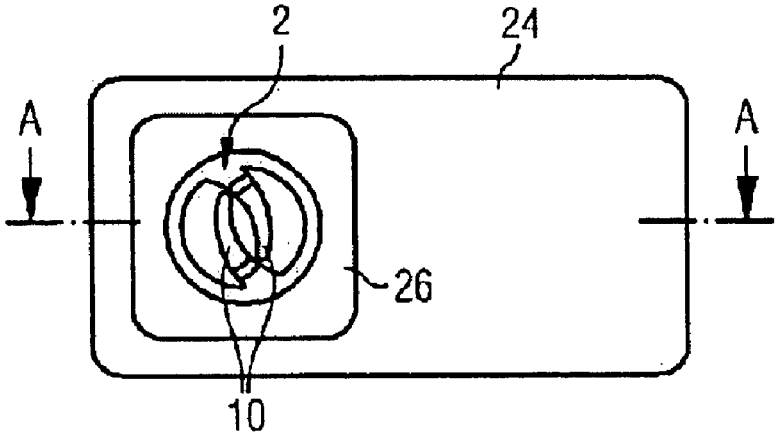
FIG. 5 shows a view from below of the dividing wall of FIG. 4.

FIG. 5 shows the view from below of the dividing wall 24 shown in FIG. 4.

Figure 6:
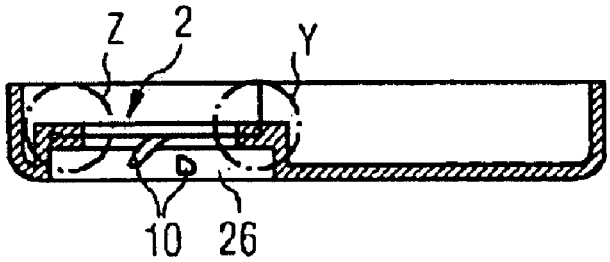
FIG. 6 shows a cross-section through the dividing wall of FIG. 4.

FIG. 6 shows a detail through the dividing wall 24 along the plane A/A of FIG. 5.

Figure 7:
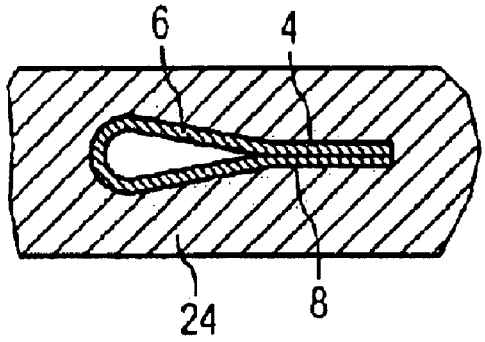
FIG. 7 shows a detail from FIG. 6 in enlarged scale.
Figure 8:
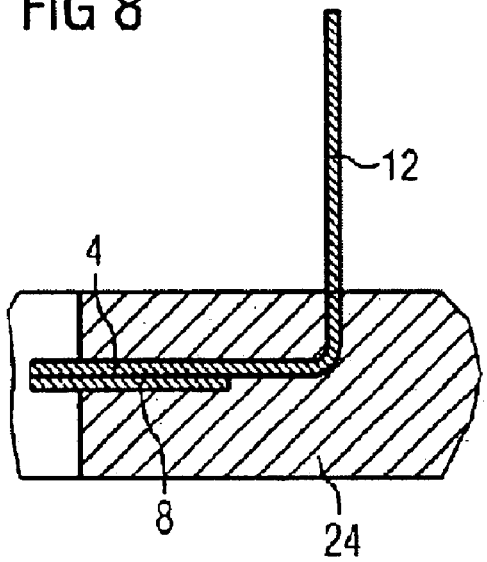
FIG. 8 shows a detail from FIG. 6 in enlarged scale.

FIG. 7 shows a detail Z from FIG. 6, and FIG. 8 shows a detail Y from FIG. 6.

One can see from FIG. 7 how the connecting area 6, together with the attached edge areas of the base piece 4 and the contact piece 8, is arranged in the dividing wall 24 and how it is enclosed by this molding. FIG. 8 illustrates how the edge areas of the base piece 4 and the contact plate 8 are enclosed in the molding of the dividing wall 24 and how the bent contact lug 12 projects out of the dividing wall.

Figure 9:
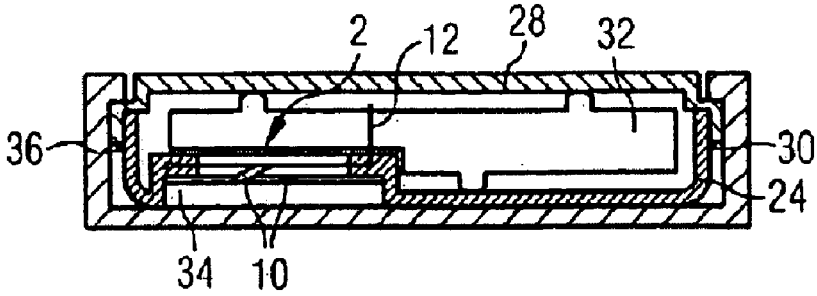
FIG. 9 shows a cross-section through a device containing an electrical connection according to the invention.

FIG. 9 shows the dividing wall 24 contained in an electrical device with the electrical connection provided by the contact plate. The dividing wall 24 is connected with an hermetic seal to a cover piece 28 of a housing, for example by thermal bonding along a seam 30. An hermetically sealed chamber is formed between the dividing wall 24 and the cover piece 28, in which is arranged an electrical component, for example a printed circuit board 32, having an electrically conducting connection to the contact lug 12.

A battery in the form of a button cell 34 is arranged in the recess 26 (FIG. 6) of the dividing wall 24. This button cell 34 is pressed in position against the spring tongues 10 under their elastic deformation by a housing lower-piece 36, which is clipped onto the cover piece 28 for example, thereby producing both an electrically reliable contact and a vibration-proof mounting of the button cell 34.

The above description only concerned a single-pole contact or electrical connection, for example between the button cell 34 and the printed circuit board 32, the spring tongue 10 making contact with one face of the button cell. A contact can be made with the other pole of the button cell, for example its side wall, by means of a contact lug not shown that is molded into the dividing wall 24 and taken through the dividing wall outside the plane of the base piece 4 and the connecting piece 6, this contact lug projecting like the contact lug 12 into slots formed on both sides of the die cavity 22 (FIG. 3) in the lower part 14 and the upper part 16.

Of course the device of FIG. 9, which, for example, may be a remote control having an infrared or ultrasound transmitter and receiver arranged in the cover piece 28, can be constructed in a completely different way. A plurality of contact plates can be provided, arranged side by side and bonded to the dividing wall, so that there are a plurality of button cells for the power supply, connected in series or parallel by suitable contacts and conducting tracks. The contact into the hermetically sealed chamber can also be effected here by means of a spring contact with suitable design of the contact lug 12. The contact plate need not be punched with a circular shape for the base piece and the contact piece, but can have any other suitable shape. Furthermore, the contact piece 8 can also be formed by just one spring tongue projecting from the connecting piece 6. The embodiment described with reference to FIGS. 1 and 2 is particularly advantageous in that the contact plate is held particularly securely by the base piece lying on the contact piece, and in that the aperture in the dividing wall is completely sealed as a result of the flat design of the base piece 4. The design of the injection molding tool of FIG. 6 has the advantage that the injection pressure is not applied to the flat area of the base piece 4 of the contact plate, so that one can work with thin contact plate. Of course, where the dividing wall is manufactured in another way, the contact plate can be covered over a large area with plastic. The embodiment illustrated offers great freedom in the design of the spring tongues.

One application of the invention, for instance, is a vehicle key with integral remote-control section, the key bit being molded with a housing part, and an operating button, preferably sealed, for example, by means of a bellows, or designed as an hermetically sealed sensor switch, being arranged on the housing for operating the remote control.

The invention is suitable for use for all types of electrical devices, such as operating parts having integral electronics, control devices, transponders with own battery etc., in which an electrical connection between an hermetically sealed space and an outer space is required, in particular if a component is arranged in the outer space that is meant to be mounted securely against vibration by a resiliently flexible contact made with an area of a contact plate providing an electrical connection. Additional retaining springs etc. can be saved in this way.

We claim:

1. An electrical connection passing through a dividing wall, comprising a contact plate having a base piece covering a surface of contacting piece, and a contact piece connected to the base piece via a connecting piece, wherein the perimeter of the base piece, including the attached area of the connecting piece, is held and sealed in the dividing wall, and the contact piece has an elastically deformable area exposed for making contact with a component.

2. The electrical connection as claimed in claim 1, wherein the elastically deformable contact piece is formed by at least one spring tongue punched out of the contact piece.

3. The electrical connection as claimed in claim 1, wherein the base piece seals an aperture formed in the dividing wall.

4. The electrical connection as claimed in claim 3, wherein the elastically deformable contact piece is formed by at least one spring tongue punched out of the contact piece.

5. The electrical connection as claimed in claim 1, wherein a contact lug protrudes sealed from the dividing wall from a perimeter area of the base piece on the opposite side from the contact piece.

6. The electrical connection as claimed in claim 5, wherein the dividing wall seals a chamber of a housing in which is held an electrical circuit connected to the contact lug, and the device contains a battery compartment in which is held, allowing replacement, a battery pressed elastically in position against a facing surface by the spring tongue.

7. The electrical connection as claimed in claim 1, wherein the base piece and the contact piece have an approximately matching perimeter shape and are arranged one above the other by bending the connecting piece through about 180°, at least one spring tongue is punched out of the contact piece, said tongue projecting from the opposite side from the base piece, a contact lug extends from a perimeter area of the base piece, and the perimeters of the base piece and contact piece arranged above each other are held in the edge of the aperture of the dividing wall in such a way that the at least one spring tongue is exposed on one side of the dividing wall, and the contact lug is exposed on the other side of the dividing wall.

8. The electrical connection as claimed in claim 7, wherein the dividing wall seals a chamber of a housing in which is held an electrical circuit connected to the contact lug, and the device contains a battery compartment in which is held, allowing replacement, a battery pressed elastically in position against a facing surface by the spring tongue.

9. An electrical connection for insertion into a dividing wall having an opening, comprising:

a contact plate having a base piece covering said opening, and a contact piece arranged on top of said base piece and coupled with said base piece via a connecting piece, wherein said contact plate fits in said opening of said dividing wall, and the contact piece has an elastically deformable area exposed for making contact with a component.

10. The electrical connection as claimed in claim 9, wherein the elastically deformable contact piece is formed by at least one spring tongue punched out of the contact piece.

11. The electrical connection as claimed in claim 9, wherein the base piece seals said opening.

12. The electrical connection as claimed in claim 11, wherein the elastically deformable contact piece is formed by at least one spring tongue punched out of the contact piece.

13. The electrical connection as claimed in claim 9, wherein a contact lug protrudes sealed from the dividing wall from a perimeter area of the base piece on the opposite side from the contact piece.

14. The electrical connection as claimed in claim 13, wherein the dividing wall seals a chamber of a housing in which is held an electrical circuit connected to the contact lug, and the device contains a battery compartment in which is held, allowing replacement, a battery pressed elastically in position against a facing surface by the spring tongue.

15. The electrical connection as claimed in claim 9, wherein the base piece and the contact piece have an approximately matching perimeter shape and are arranged one above the other by bending the connecting piece through about 180°, at least one spring tongue is punched out of the contact piece, said tongue projecting from the opposite side from the base piece, a contact lug extends from a perimeter area of the base piece, and the perimeters of the base piece and contact piece arranged above each other are held in the edge of the aperture of the dividing wall in such a way that the at least one spring tongue is exposed on one side of the dividing wall, and the contact lug is exposed on the other side of the dividing wall.

16. The electrical connection as claimed in claim 15, wherein the dividing wall seals a chamber of a housing in which is held an electrical circuit connected to the contact lug, and the device contains a battery compartment in which is held, allowing replacement, a battery pressed elastically in position against a facing surface by the spring tongue.

17. A method for manufacturing an electrical connection passing through a dividing wall, comprising the following steps:

Manufacture of a flat part punched from metal plate having a base piece and a contact piece connected to the base piece via a connecting piece, wherein the base piece and the contact piece have approximately matching perimeter shapes, and a contact lug projects from a perimeter area of the base piece, Punching out of at least one spring tongue from the contact piece, and bending of the spring tongue out from the contact piece, Bending of the contact lug out of the base piece in the same direction as the spring tongue, Arranging base piece and contact plate above each other by bending the connecting piece through about 180° in such a way that the spring tongue projects on one side and the contact lug on the other, Introduction of the plate part formed in such a way into an injection molding tool in such a way that only the perimeter edges of base piece and contact piece and the bent-over connecting piece project sealed into a die cavity corresponding to the dividing wall, wherein the bent contact lug is located in a recess of the injection molding, Injection molding of the dividing wall, and Removal of the dividing wall from the injection molding tool together with the plate part held in the dividing wall at its perimeter edges and by the connecting piece.

* * * * *